US009422073B2

(12) United States Patent
Picozza et al.

(10) Patent No.: US 9,422,073 B2
(45) Date of Patent: Aug. 23, 2016

(54) VACUUM PACKAGING APPLIANCE WITH ROLL STORAGE

(75) Inventors: Augusto Picozza, Boca Raton, FL (US); Richard Neil Tobin, Wellington, FL (US); Andrew L. Hall, Hendersonville, TN (US); Jeffrey A. Smith, Pompano Beach, FL (US)

(73) Assignee: Sunbeam Products, Inc., Boca Raton, FL (US)

( * ) Notice: Subject to any disclaimer, the term of this patent is extended or adjusted under 35 U.S.C. 154(b) by 1159 days.

(21) Appl. No.: 13/445,605

(22) Filed: Apr. 12, 2012

(65) Prior Publication Data

US 2013/0097967 A1 Apr. 25, 2013

Related U.S. Application Data

(60) Provisional application No. 61/474,378, filed on Apr. 12, 2011.

(51) Int. Cl.

*B65B 31/04* (2006.01)
*B65B 51/14* (2006.01)
*B65B 31/06* (2006.01)

(52) U.S. Cl.

CPC ..... *B65B 31/046* (2013.01); *B65B 31/04* (2013.01); *B65B 31/06* (2013.01); *B65B 51/146* (2013.01)

(58) Field of Classification Search

CPC ..... B65B 31/04; B65B 31/06; B65B 31/048; B65B 31/02; B65B 31/024; B65B 31/042; B65B 31/043; B65B 55/00; B65B 55/02; B65B 47/10; B65B 3/04; B65B 3/18; B65B 41/12; B65B 43/04; B65B 43/12; B65B 43/123; B65B 51/148; B65B 51/146; B65B 31/046

USPC ..... 53/79, 510–512, 570, 284.7, 408, 434, 53/405, 467, 469, 412, 428, 432, 452; 49/374

See application file for complete search history.

(56) References Cited

U.S. PATENT DOCUMENTS 2,463,250 A * 3/1949 Curtiss, Jr. ..... F25D 23/021 292/335
2,672,268 A 3/1954 Bower (Continued)

FOREIGN PATENT DOCUMENTS

EP 1564148 A2 * 8/2005 ..... B65B 31/046
EP 2062823 A1 * 5/2009 ..... B65B 31/02

(Continued)

*Primary Examiner* — Stephen F Gerrity
(74) *Attorney, Agent, or Firm* — Michael J. Corrigan

(57) ABSTRACT

An appliance for dispensing, forming and vacuum packaging a container is provided including a base, a vacuum motor disposed in the base, a vacuum sealing compartment formed in the base including a vacuum trough fluidly connected to the vacuum motor, a sealing element disposed in the vacuum sealing compartment adjacent the vacuum trough, and a bag roll storage compartment formed in the base vertically disposed above the vacuum sealing compartment. At least one section of the container material may be dispensed from the storage compartment and cut from the roll of container material and sealed on a first free end with the sealing element to form an unsealed container. The unsealed container may then be evacuated by the vacuum motor through a second free end inserted into the vacuum trough and/or sealed on the second free end with the sealing element to form a hermetically sealed container.

18 Claims, 10 Drawing Sheets

(56) References Cited

U.S. PATENT DOCUMENTS

| | | | | |
|---|---|---|---|---|
| 2,838,894 | A | 6/1958 | Paikens | |
| 3,597,897 | A * | 8/1971 | Gerard | B65B 31/024 53/512 |
| 4,229,244 | A | 10/1980 | Swope | |
| 5,638,664 | A | 6/1997 | Levsen et al. | |
| 5,893,822 | A * | 4/1999 | Deni | B65B 31/046 493/256 |
| 6,018,932 | A * | 2/2000 | Eberhardt, Jr. et al. | B65B 25/067 53/432 |
| 6,047,522 | A | 4/2000 | Huang | |
| 6,256,968 | B1 * | 7/2001 | Kristen | B65B 31/02 53/405 |
| 7,000,369 | B1 * | 2/2006 | Paviot | B65B 9/13 493/189 |
| 7,124,557 | B2 * | 10/2006 | Small | B65B 31/046 292/163 |
| 7,334,386 | B2 | 2/2008 | Higer | |
| 7,392,641 | B2 | 7/2008 | Abate | |
| 7,464,522 | B2 | 12/2008 | Higer et al. | |
| D624,573 | S * | 9/2010 | Hall et al. | D15/146 |
| D624,574 | S * | 9/2010 | Hall et al. | D15/146 |
| 2003/0084649 | A1 * | 5/2003 | Heil et al. | A47F 13/085 53/512 |
| 2005/0022473 | A1 * | 2/2005 | Small | B65B 51/148 53/434 |
| 2005/0050856 | A1 * | 3/2005 | Baptista | B65B 51/146 53/434 |
| 2005/0108990 | A1 * | 5/2005 | Kahn | B65B 31/046 53/432 |
| 2005/0223682 | A1 * | 10/2005 | Sung | B65B 31/046 53/512 |
| 2007/0033907 | A1 | 2/2007 | Small et al. | |
| 2010/0095638 | A1 * | 4/2010 | Zakowski | B65B 1/148 53/433 |

FOREIGN PATENT DOCUMENTS

| | | | | |
|---|---|---|---|---|
| EP | 2168876 | A2 * | 3/2010 | B65B 31/046 |
| WO | WO 2010143216 | A1 * | 12/2010 | B65B 31/046 |

* cited by examiner

VACUUM PACKAGING APPLIANCE WITH ROLL STORAGE

CROSS-REFERENCE TO RELATED APPLICATION

The present application claims priority to U.S. Provisional Patent Application No. 61/474,378 filed Apr. 12, 2011, entitled "Roll Storage Vertical Sealer".

FIELD OF THE INVENTION

The invention relates to vacuum packaging machines. More particularly, the invention is directed to a vacuum packaging machine that saves countertop space and includes convenient roll storage in a compartment above the vacuum sealing chamber.

BACKGROUND OF THE INVENTION

Preservation of food and food portions is important for a variety of economic, health, and convenience reasons. Food can be stored for longer periods of time if oxygen is excluded and the harmful effects of oxygen on food are minimized. Containers have long been used to store and transfer perishable foods and other products on their way to market for purchase by consumers. After perishable foods, such as meats, fruits, and vegetables are harvested, they may be placed into containers or atmospheres to protect them from the spoiling effects of oxygen.

Various appliances and methods are used for the purpose of vacuum packaging and sealing plastic bags and containers to protect perishables, such as foodstuffs, and other products against oxidation. Some have been adapted for home use. These appliances usually operate by receiving a container or bag, isolating the interior of the container or bag from ambient air, and drawing air from the interior of the container or bag before sealing it.

Typically, these appliances include a base and a lid pivotally attached to the base, and when the lid is in a closed position a vacuum chamber is formed between the lid and the base. The vacuum chamber is configured to receive an open end of the container or bag for evacuating the container or bag which is thereafter sealed by a sealing mechanism in the lid and/or the base. The appliance includes a vacuum source that is coupled to the vacuum chamber, whereby the vacuum source selectively evacuates the vacuum chamber.

More recently, these appliances have included additional features such as a compartment for storage of a roll of container or bag material. However, including such a feature in vacuum sealing appliances is not without its drawbacks since it increases the footprint of the appliance and the amount of countertop space in the kitchen required for storage.

SUMMARY OF THE INVENTION

In an embodiment, there is provided an appliance for vacuum packaging a container, including a base, a vacuum motor disposed in the base, a vacuum sealing compartment formed in the base including a vacuum trough fluidly connected to the vacuum motor, a sealing element disposed in the vacuum sealing compartment adjacent the vacuum trough, and a storage compartment formed in the base vertically disposed above the vacuum sealing compartment configured to store a roll of flexible container material. At least one section of the container material is dispensed from the storage compartment and cut from the roll of container material, sealed on a first free end with the sealing element to form an unsealed container, evacuated by the vacuum motor through a second free end inserted into the vacuum trough, and then sealed on the second free end with the sealing element to form a hermetically sealed container.

In an embodiment, there is provided an appliance for dispensing, forming and evacuating a bag, including a base, a first compartment formed in a lower portion of the base, a second compartment formed in the base vertically disposed above the first compartment configured to store a roll of bag material, a vacuum trough disposed in the first compartment, a sealer disposed in the first compartment adjacent the vacuum trough, and a vacuum source connected to the vacuum trough. At least one section of the bag material is dispensed from the second compartment and cut from the roll of bag material, sealed on one free end with the sealer to form a partially formed container sealed on three sides, evacuated by the vacuum source through another free end opposite the one free end and inserted into the vacuum trough, and then sealed on the opposite free end with the sealer to form a hermetically sealed bag.

In an embodiment, there is provided a method of dispensing, forming and vacuum sealing a container, including a step of opening a lid to a storage compartment formed in a housing and vertically disposed above a vacuum sealing compartment. The method further includes the steps of lifting a cutter bar, placing a free end of a roll of container material stored in the storage compartment under the cutter bar, lowering the cutter bar, and dispensing and cutting a section of the container material from the roll of container material with the cutter bar. The method further includes the steps of lifting a handle to open an access door to the vacuum sealing compartment, and inserting the free end of the section of container material into the vacuum sealing compartment and over a heat sealing strip. The method further includes the steps of lowering the handle to close the access door to the vacuum sealing compartment, and energizing the heat sealing strip to seal the free end of the section of container material to form a partially formed container. The method further includes the steps of lifting the handle to open the access door, and removing the partially formed container from the vacuum sealing compartment. The method further includes the steps of inserting food items into the partially formed container, inserting an opposite free end of the partially formed container into the vacuum sealing compartment, and evacuating the container and sealing the opposite free end of the container. The method further includes the steps of lifting the handle and removing the sealed container from the vacuum sealing compartment.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
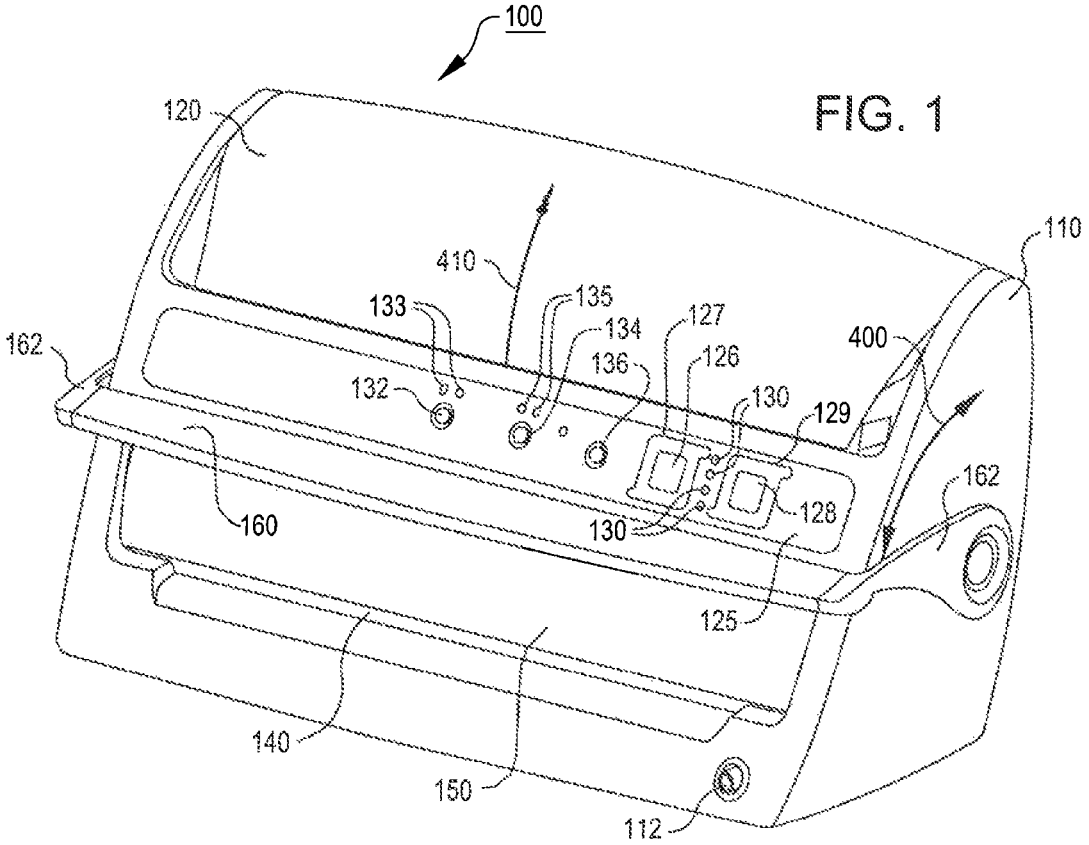
FIG. 1 is a front perspective view of an embodiment of a vacuum packaging appliance with a roll storage compartment vertically disposed above a vacuum sealing chamber.
Figure 2:
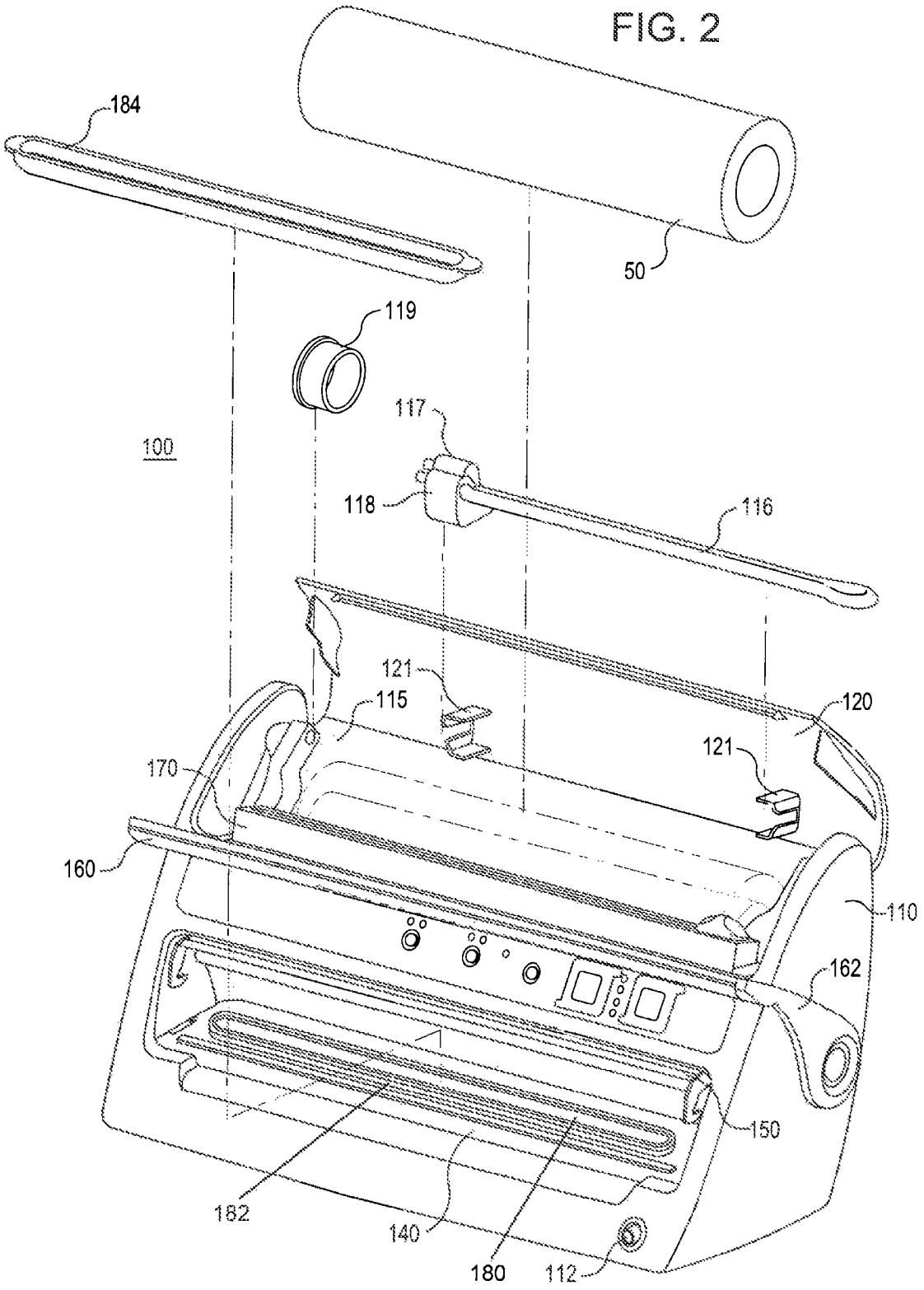
FIG. 2 is a partially exploded front perspective view of the vacuum packaging appliance of FIG. 1 with a lid to the roll storage compartment in an open position and the contents therein exploded.

Referring now to the drawing figures in which like reference designators refer to like elements, there is shown in FIGS. 1-2 an exemplary embodiment of a vacuum sealing appliance 100 with a storage compartment 115 for a roll 50 of flexible container material. The storage compartment 115 is vertically disposed above a vacuum sealing compartment 140. In the illustrated embodiment, the flexible container material is a roll 50 of flattened, tubular container material and is stored in the compartment without support mechanisms and is free to rotate therein.

In an embodiment, the roll 50 of container material is stored in the compartment with support mechanisms (not shown) and is free to rotate therein In the exemplary embodiment, the vacuum sealing appliance 100 includes a base 110 with the storage compartment 115 formed in an upper portion and a lid 120. The lid 120 is hingedly connected to the upper portion of the base 110 for enclosing the compartment 115. The lid 120 is pivotally movable between a closed position, as shown in FIG. 1, and may be moved in the direction of arrow 410 to an open position as shown in FIG. 2, for allowing access to the roll 50 of the container material for dispensing.

Figure 3:
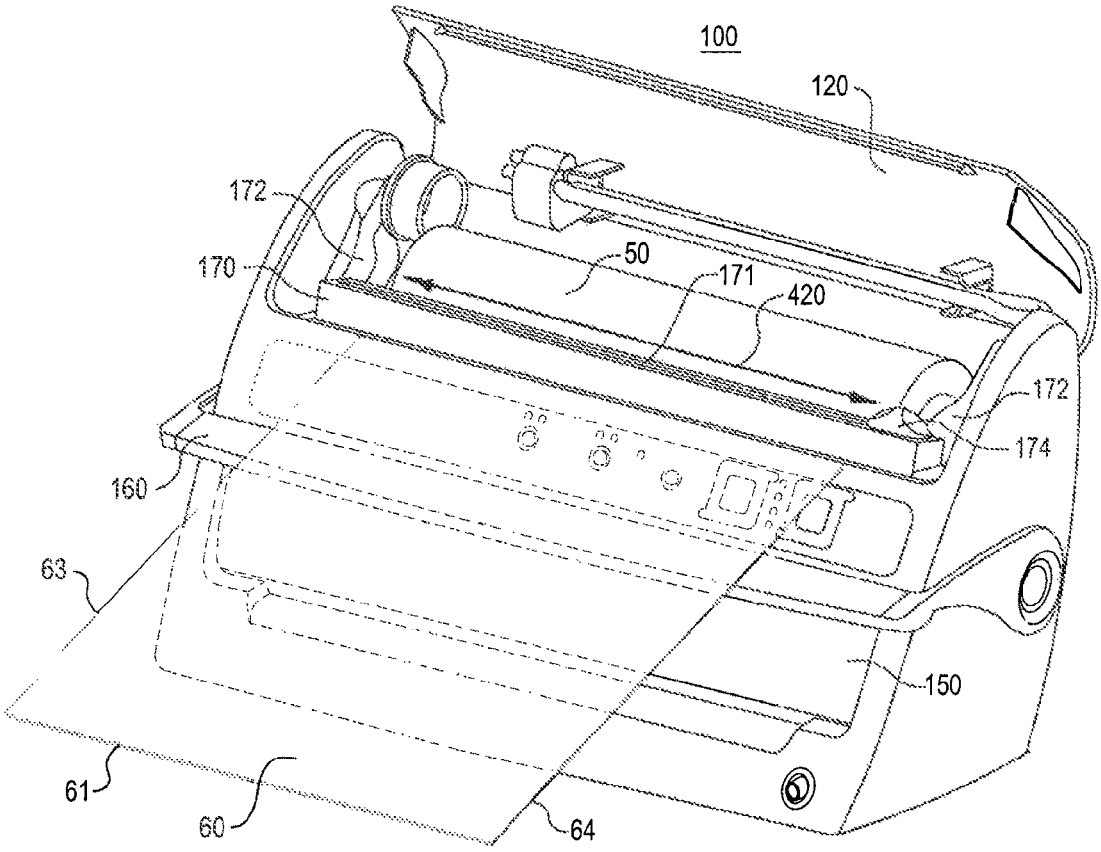
FIG. 3 is another front perspective view of the vacuum packaging appliance of FIG. 1 with a lid to the roll storage compartment in an open position and a section of a flexible tubular container material dispensed from the roll of container material.

Referring now also to FIG. 3, in an embodiment the container material may be dispensed from the storage compartment 115 for conveniently allowing the user to create a custom made flexible container or bag 60 from the roll 50 of container material. With the lid 120 in the open position, the user pulls on the free end 61 of the roll 50 and dispenses an appropriate amount of container material having pre-sealed edges 63, 64. The free end 61 of the container material is inserted underneath a pivoting cutter bar 170 and the container material is pulled on the free end 61 to dispense the container material from the roll 50.

In an embodiment, the bar cutter 170 may be pivotally connected to the interior of the roll storage compartment 115 by a pair of opposing arms 172. The cutter bar 170 may include a cutting mechanism or cutting blade 174 that slides within a track 171 formed in the cutter bar 170. The user then preferably slides the cutting mechanism 174 along the track 171 to the opposing end of the lid 120 in the direction of arrow 420, whereby the cutting mechanism 174 cuts the bag material to provide the user with separated pieces of flexible material or a partially formed container 60. It should be noted that the cutting mechanism 174 is able to be moved in a direction from left to right as well as right to left along the track 171 to cut the flexible container material. Alternately, the user does not dispense the flexible container material from the compartment 115 and/or does not cut the flexible container material using the cutter bar 170 and the cutting mechanism 174.

It should be noted that the vertical design of the compartment 115 and the design of the pivoting cutter bar 170 allows the roll 50 of container material to be inserted into the compartment 115 from the top or front. The cutter bar 170 also has a special feature that holds the cutter bar 170 in the open position, while the roll 50 of container material is loaded. The compartment 115 by design restrains the roll 50 of container material in place as a section of container material is dispensed and gives the consumer a clear view to allow selection of any length food container.

In an embodiment, the storage compartment 115 is eliminated and sections of flexible container material from another source are evacuated and/or sealed using the vacuum sealing appliance 100 described below.

In an embodiment, after dispensing and cutting a section of container material, the free end 61 of the section of container material may be sealed such as by heat sealing. Food items may then be placed inside the partially formed container 60 followed by the partially formed container 60 being evacuated, and then the remaining free end 62 (FIG. 4) may be heat sealed as described below to form a hermetically sealed container 60 that retains the freshness of the food items therein. Oppositely, the free end 62 may be heat sealed first followed by placing the food items in the partially formed container 60, followed by the partially formed container 60 being evacuated, and then the remaining free end 61 being heat sealed.

In an embodiment, the foregoing vacuum and/or heat sealing operations are controlled by the user through the use of an electronic control panel 125 that is disposed directly beneath the lid 120 on the front face of the base 110. The electronic control 125 panel may include electronic switches 126, 128, 132, 134 and 136. The control panel 125 is electrically coupled to at least one vacuum source VM (FIG. 6) as well as a sealing mechanism 190 (FIG. 4), whereby operation of the vacuum source VM (FIG. 6) and/or sealing mechanism 190 (FIG. 4) are controlled at the electronic control panel 125.

For example, the electronic switch 126 may be depressed for commencing a sealing only operation and includes related indicia 127 which may be lighted to indicate that the sealing operation on one of the free ends 61, 62 of the container 60 to be sealed has commenced. In this regard, it may be desirable to commence a sealing only operation on the free end 62 (FIG. 4) after dispensing a length of container material to form a partially formed container 60 where three sides are sealed. Food items may now be placed inside the partially formed container 60 which may be processed further by evacuating and/or sealing the unsealed free end 61 as described below. In an embodiment, the indicia 127 may be a light emitting diode or other light source.

In another example, the electronic switch 128 may be depressed for commencing a vacuum and sealing operation and includes related indicia 129 which is lighted to indicate that evacuating the partially formed container 60 followed by beat sealing the unsealed free end 61 of the partially formed container 60 has commenced. In this regard, it may be desirable to commence an evacuating and heat sealing operation on the partially formed container 60 after one of the free ends 61, 62 has been heat sealed and food items have been placed into the partially formed container 60. After the partially formed container 60 has been evacuated for a pre-determined time, the unsealed free end 61, 62 may be heat sealed to form a hermetically sealed container 60 for keeping the food items fresh. In an embodiment, the indicia 129 may be a light emitting diode or other light source.

In an embodiment, a plurality of indicia 130 comprising alternately lighted amber and green lights that light as the evacuating and/or sealing operations commence and progress. For example, initially as evacuating and/or sealing operations commence the lower most indicia 130 may be lighted green and the indicia 130 vertically disposed above may be all red. As the evacuating and/or sealing operations progress, the next vertically indicia 130 may change from red to green until all of the indicia 130 have changed from red to green. In an embodiment, the plurality of indicia 130 may be four indicia and each represents a twenty-five percent (25%) increment of the evacuating and/or sealing operating cycle. In an embodiment, initially as evacuating and/or sealing operations commence the lower most indicia 130 may be lighted red and the indicia 130 vertically disposed above may be all green. As the evacuating and/or sealing operations progress, the next vertically spaced indicia 130 may change from green to red until all of the indicia 130 have changed from green to red to signify the completion of the cycle.

Figure 6:
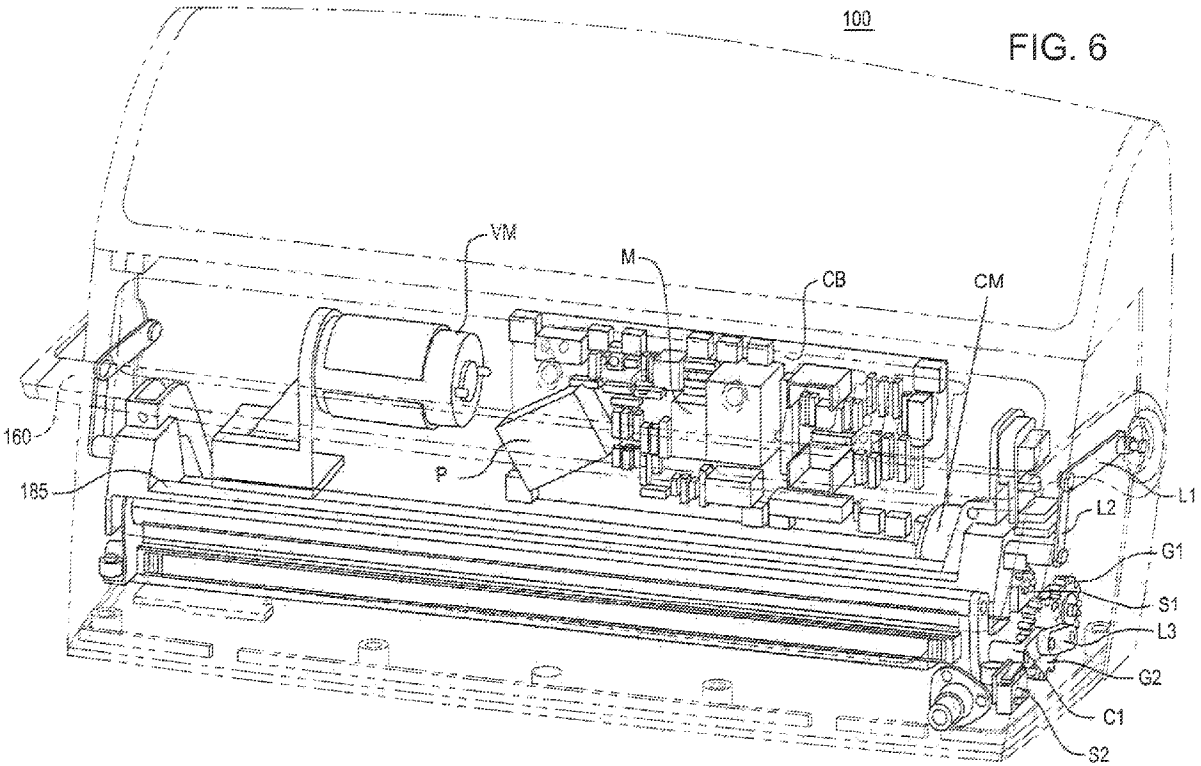
FIG. 6 is a partially cutaway front perspective view of the vacuum packaging appliance of FIG. 1 illustrating an arrangement of electronic components with an interior of a housing for the appliance.

In an embodiment, an electronic switch 112 is provided to select an evacuating or vacuuming speed which when depressed a user can select a "normal" or a "gentle" speed as respectively indicated by one of the indicia 133, 133. The electronic switch 132 is electronically linked to the vacuum motor VM (FIG. 6) and controls the operating speed of the vacuum motor VM (FIG. 6). For example, the user may desire to evacuate the food container more slowly dependent upon the food items in the food container. For softer foods such as bread that may easily crushed it may be desired to evacuate the food container with lower vacuum which is selected by depressing the electronic switch 132 until the indicia 133 indicates that the "gentle" speed has been selected. In an embodiment, the indicia 133 may be a light emitting diode or other light source.

Figure 4:
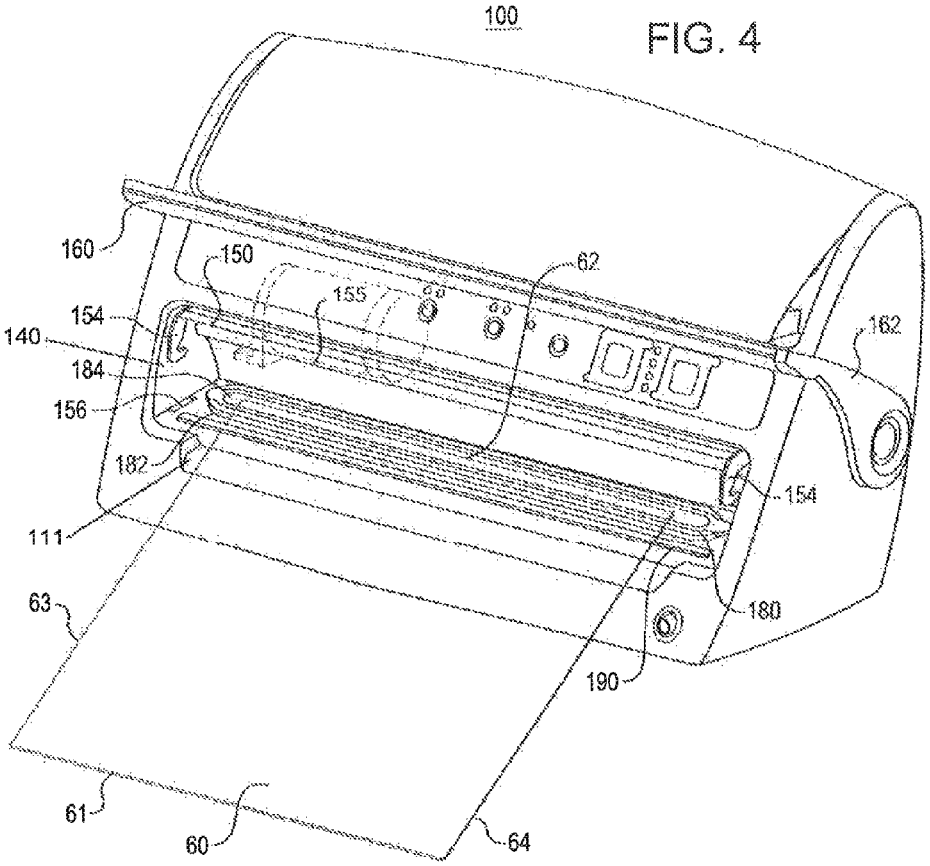
FIG. 4 is another front perspective view of the vacuum packaging appliance of FIG. 1 with a front access door opening into a vacuum sealing compartment in an open position and a free end of a cut section of the container material inserted into a lower vacuum trough.

In an embodiment, electronic switch 134 is provided to select a food moisture content which when depressed a user can select a "dry" or a "moist" food moisture content as respectively indicated by one of the indicia 135, 135. For example, for foods with a higher moisture content it may be desired to depress electronic switch 134 until the indicia 135 indicates that the "moist" food content has been selected. The electronic switch 134 is electronically linked to an extra-wide heat sealing strip 190 (FIG. 4) which seals the unsealed free end 61, 62 of the partially formed container 60. When the electronic switch 134 is depressed to select the "moist" setting, the heat sealing strip 190 (FIG. 4) is energized for a longer pre-determined time due to the tendency of the moisture content in the food to cool the container material in the vicinity of the seal thus requiring a longer sealing time by the heat sealing strip 190 (FIG. 4). In an embodiment, the indicia 135 may be a light emitting diode or other light source.

Finally, in an embodiment electronic switch 136 is provided which when depressed will "cancel" all vacuuming and/or sealing operations that have previously been commenced. The electronic switches 126, 128, 132, 134 and 136 and indicia 127, 129, 130, 133 and 135 are connected to a circuit board CB (FIG. 6) which includes a microprocessor M (FIG. 6) for controlling the operation of the vacuum motor VM (FIG. 6) and the heat sealing element 190 (FIG. 4).

Referring now also to FIG. 4, in an embodiment an elongated vacuum sealing compartment 140 is disposed directly beneath the appliance control panel 125 wherein one of the unsealed free end(s) 61, 62 of the partially formed container 60 is inserted for sealing and/or evacuating the container 60 in the sequences described below. In an embodiment, an operation handle or latch bar 160 is pivotally connected to opposing sides of the base 110 by a pair of arms 162. The handle 160 is movable between first (closed) and second (open) positions in the direction of arrow 400 for controlling the operation of a front access door 150 that covers an opening in housing 110 that leads into the vacuum sealing compartment 140.

The front access door 150 is permanently linked to the handle 160 and is movable between the first (FIG. 1) and open second (FIG. 4) positions to allow the user access inside of the vacuum sealing compartment 140 for evacuating and/or sealing the partially formed container 60. The mechanism linking the handle 160 to the front access door 150 restrains the front access door 150 in the open position to allow the user access inside the vacuum sealing compartment 140 to position the partially formed container 60 for evacuating and/or sealing and to also remove excess evacuated liquids accumulated in a drip tray 184 (shown removed in FIG. 2) positioned in a lower vacuum trough 180.

Figure 7:
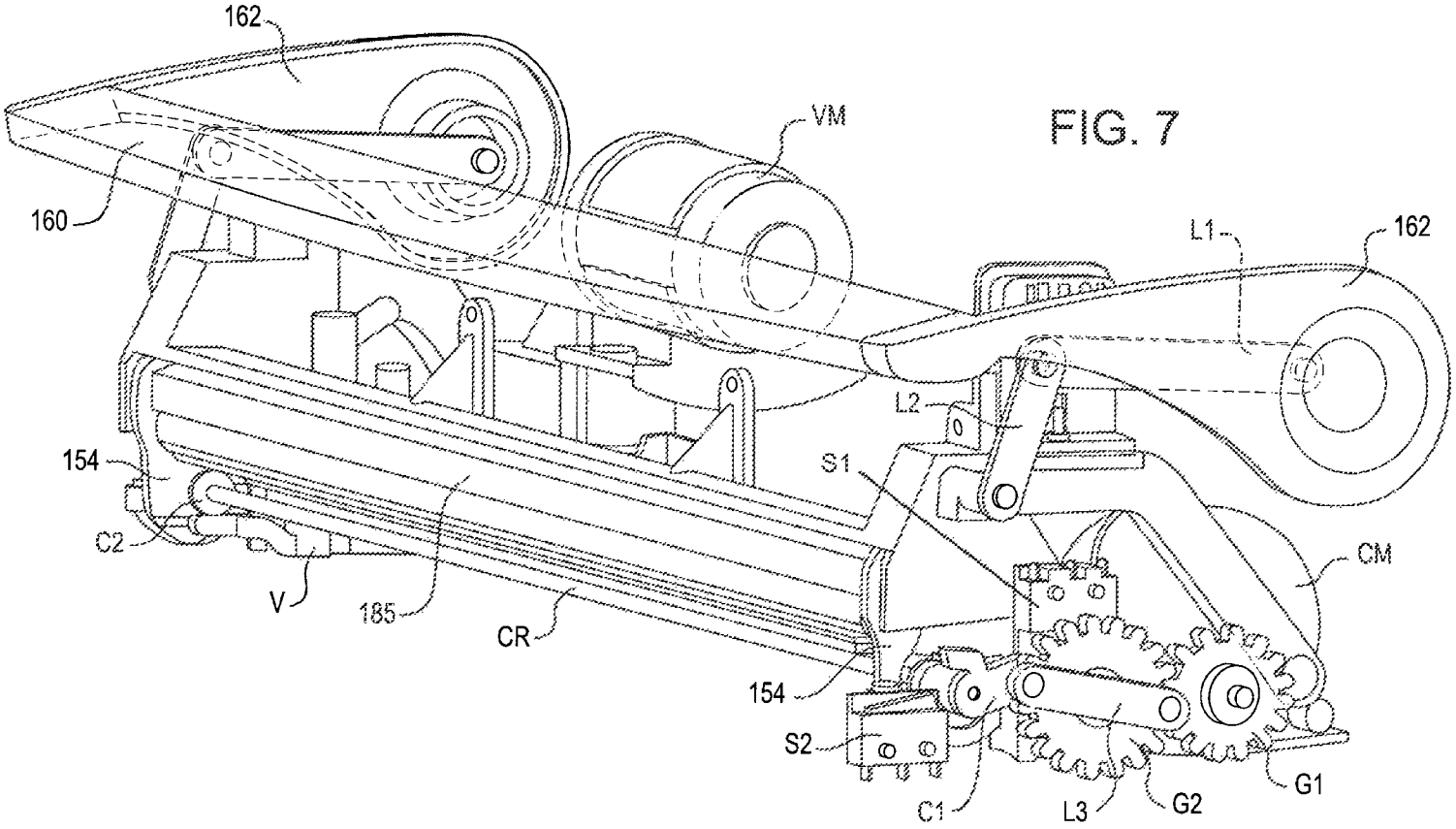
FIG. 7 is an enlarged front perspective view of a upper vacuum chamber and pivoting handle assembly for the vacuum packaging appliance of FIG. 1.
Figure 8:
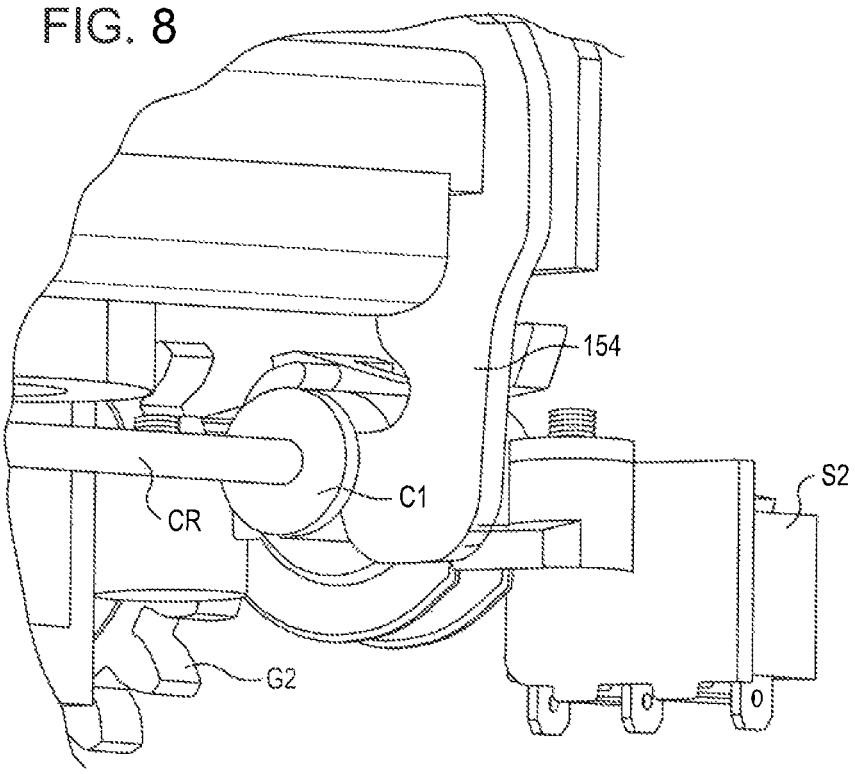
FIG. 8 is an enlarged front perspective view of a lower right portion of the upper vacuum chamber and pivoting handle assembly illustrated in FIG. 7 for the vacuum packaging appliance of FIG. 1.
Figure 9:
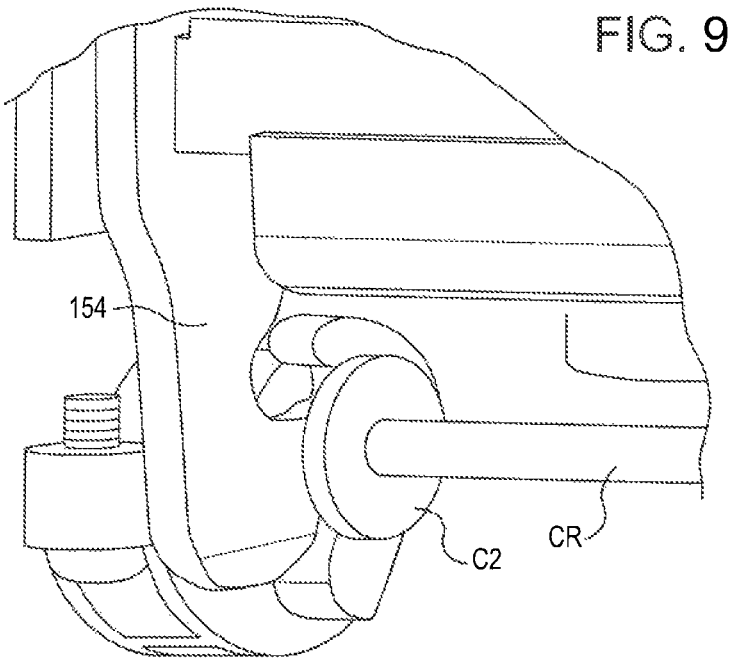
FIG. 9 is an enlarged front perspective view of a lower left portion of the upper vacuum chamber and pivoting handle assembly illustrated in FIG. 7 for the vacuum packaging appliance of FIG. 1.

The movement of the handle 160 also controls the movement of the upper vacuum chamber 185 (FIGS. 6-7) disposed behind the front access door 150 between an upper unsealed position and a lower sealed position. In the lower position, the upper vacuum chamber 185 (FIG. 6) and the vacuum trough 180 together form a sealed vacuum chamber which is evacuated by the vacuum motor VM (FIG. 6) when the electronic switch 178 is depressed. A gasket 182 rings the periphery of the vacuum trough 180 to form a seal between the upper vacuum chamber 185 (FIGS. 6-7) and the vacuum trough 180 when the upper vacuum chamber 185 is in the lower sealed position.

For example, when the handle 160 is in the second position shown in FIG. 4, the front access door 150 is in an open configuration for allowing one of the free ends 61, 62 of the partially formed container 60 to be inserted into the drip tray 184 in the lower vacuum trough 180 disposed in the vacuum sealing compartment 140. It has been found to be helpful to curl the free end 61 62 of the partially formed container 60 before inserting it into the drip tray 184 in the vacuum trough 180. The housing 110 in the area in front of the lower vacuum trough 180 has a chamfered edge 111 to aid in alignment of the insertion of the partially formed container 60 into the drip tray 184 in the vacuum sealing trough 180.

The upper vacuum chamber 185 (FIGS. 6-7) is also restrained in the upper unsealed position for allowing the free end 61, 62 of the partially formed container 60 to be inserted into the drip tray 184 in the vacuum trough 180. The area adjacent the free end 61, 62 of the partially formed container 60 is also placed over the heat sealing strip 190 disposed in the housing 110 adjacent the vacuum trough 180 when the free end 61, 62 is inserted into the drip tray 184 in the vacuum trough 180. In addition, when the handle 160 is in the open or second position the electronic controls 126, 128, 132, 134 and 136 on control panel are inoperative such that evacuating the partially formed container 60 and/or sealing the free ends 61, 62 of the partially formed container 60 are not possible.

Figure 5:
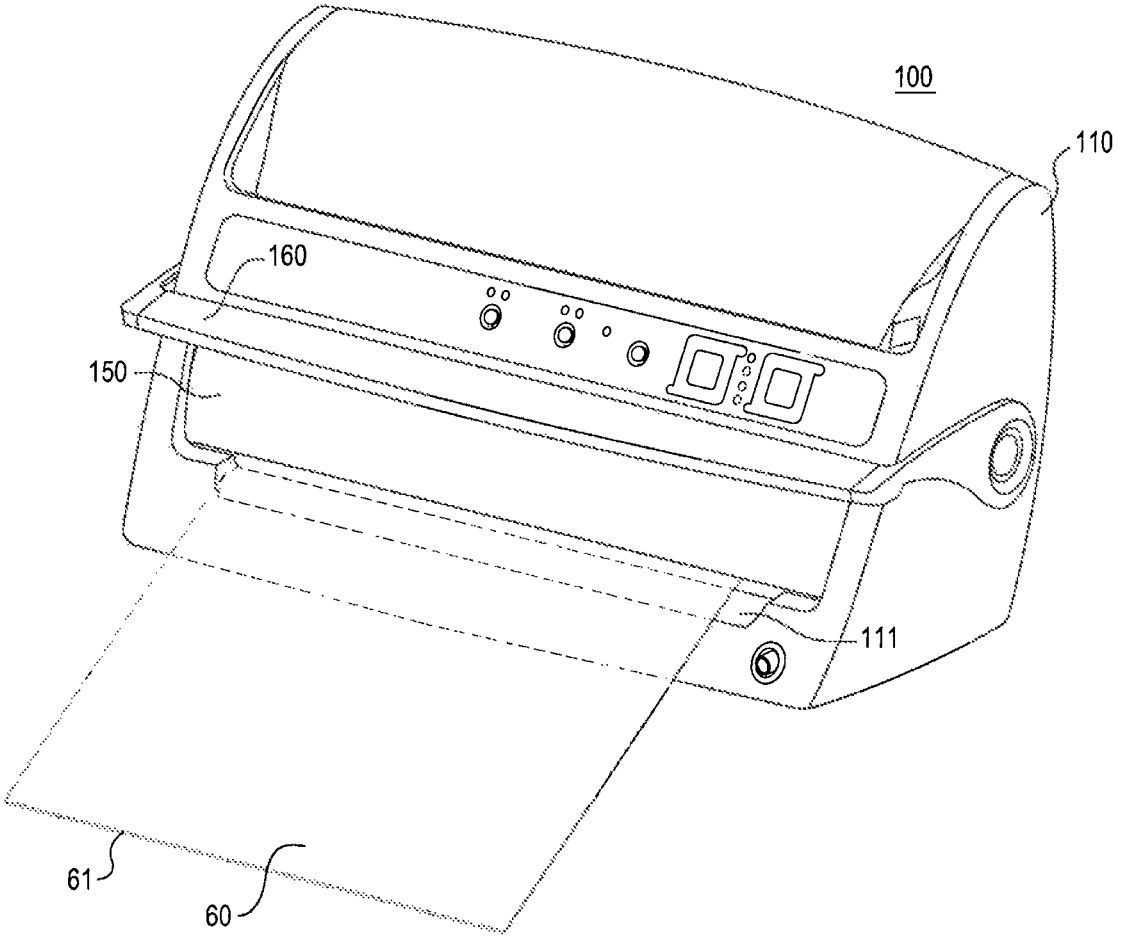
FIG. 5 is another front perspective view of the vacuum packaging appliance of FIG. 1 with a front access door opening into a vacuum sealing compartment in a closed position and a free end of a cut section of the container material inserted into a lower vacuum trough.

Referring now also to FIG. 5, after one of the free ends 61, 62 is inserted into the drip tray 184/lower vacuum trough 180 in the vacuum sealing compartment 140, the handle 160 may be moved from the second position or open configuration back to the first position or the closed configuration moving the front access door 150 to the closed position, and allowing the electronic controls 126, 128, 132, 134 and 136 on electronic control panel 125 to operate, in addition, the upper vacuum chamber 185 (FIGS. 6-7) is moved to the lower sealed position such that the upper vacuum chamber 185 (FIGS. 6-7) and the vacuum trough 180 form the composite sealed vacuum chamber where the partially formed container 60 is evacuated through the free end 61, 62 trapped therebetween.

Referring now also to FIGS. 6-9, once the handle 160 is moved to the closed configuration, a linkage L1 engages a switch S1 which energizes a clamping motor CM. The clamping motor CM rotates a plurality of gears G1, G2 which through a linkage L3 rotates a pair of cams C1, C2 on either side of the housing 110 in a first direction to engage complementary latches 154, 154 (shown enlarged in FIGS. 8 and 9) extending from the bottom of the front access door 150. The cam C2 on the left side of the housing 110 is rotated in the first direction when cam C1 is rotated through a rotating clamping rod CR that interconnects cams C1 and C2 and extends longitudinally across the housing 110 in the vicinity of the lower vacuum trough 180. The latches 154 pass through slots 156 (only one seen in FIG. 4) formed in the bottom wall of the vacuum sealing compartment 140 to engage the respective cams C1, C2 disposed beneath the vacuum sealing compartment 140.

When rotated in the first direction, the cams C1, C2 urge the latches 154, 154 downward causing the front access door 150 to be pulled tightly shut into a locked position. Once the front access door 150 is pulled into the locked position, the cam C1 on the right side of the housing 110 engages another switch S2 which turns off the clamping motor CM rotating the cams C1, C2. The engagement of the switch S2 also sends a signal to the microprocessor M to energize the control panel 125 so that the electronic controls 126, 128, 132, 134 and 136 are operable.

For example, with the handle 160 in the closed configuration the free end 62 of the partially formed container 60 is gripped firmly between a resilient bumper 155 on the bottom edge of the front access door 150 and the heat sealing strip 190. The user may select the electronic control 126 when it is desired to seal only the free edge 62 of the partially formed container 60. The electronic control 126 when depressed causes the heating sealing strip 190 to be energized for a pre-determined time which seals the layers of the container material together at the free end 62.

After the pre-determined time has elapsed, the microprocessor M signals the clamping motor CM to rotate in a reverse direction causing the cams C1, C2 to rotate in a second opposite direction releasing the latches 154, 154. The clamping motor CM is energized until the latches 154, 154 are released and the linkage L1 releases the switch S1 which signals the microprocessor M to de-energize the electronic controls 126, 128, 132, 134 and 136. The handle 160 may now be moved to the open configuration causing the front access door 150 to open and the free end 62 of the partially formed container 60 may be removed from the vacuum sealing compartment 140.

Once the partially formed container 60 has been removed from the vacuum sealing compartment 140, food or other perishable items may be placed into the partially formed container 60. The other free end 61 of the partially formed container 60 may be inserted into the drip tray 184 in the lower vacuum trough 180 for both evacuating the partially formed container 60 and/or sealing the free end 61. Again, after the free end 61 is inserted into the drip tray 184 in the lower vacuum trough 180, the handle 160 may be moved to the closed position causing the front access door 150 to close and lock.

Upon the handle 160 being moved to the closed position, the linkage L1 engages the switch S1 which energizes the clamping motor CM which through the plurality of gears G1, G2 and linkage L3 rotates the pair of cams C1, C2 on either side of the housing 110 to engage the latches 154, 154 extending from the bottom of the front access door 150. Once the front access door 150 is pulled tight into the locked position by the latches 154, 154, the cam C1 on the right side of the housing 110 engages another switch S2 which turns off the clamping motor CM rotating the cams C1, C2. The engagement of the switch S2 also energizes the control panel 125 so that the electronic controls 126, 128, 132, 134 and 136 are operable.

With the food items now in the partially formed container 60, it may be desirable to evacuate the partially formed container 60 and seal the unsealed free end 61. This may be performed by the user depressing the electronic control 128. This sends a signal to the microcontroller M to energize the vacuum motor VM which is fluidly connected to the lower vacuum trough 180. The speed of the vacuum motor VM is variable based on input from the electronic control 132 which allows the user to select a vacuum motor VM speed that is "normal" or slower but more "gentle" as described above.

The vacuum motor VM is energized until a pre-determined pressure is achieved in the lower vacuum trough 180. The pressure in the lower vacuum trough 180 is measured by a pressure transducer P disposed on the circuit board CB and fluidly connected to the vacuum motor VM. When the pressure transducer P senses the pre-determined pressure, the microcontroller M de-energizes the vacuum motor VM. The lower pressure in the lower vacuum trough 180 draws air and liquids from the partially formed container 60 through the free end 61 until the pre-determined pressure in the lower vacuum trough 180 is released. Excess liquid drawn from the partially formed container 60 through the free end 61 may be collected in the removable drip tray 184 seated in the lower vacuum trough 180.

After the pre-determined pressure has been reached in the lower vacuum trough 180 and the vacuum motor VM has been de-energized, the microcontroller M energizes the heating sealing strip 190 for the pre-determined sealing time. The pre-determined sealing time is variable based on input from the electronic control 134 which allows the user to select a "dry" or a "moist" food moisture content as described above. Both the pre-determined vacuum motor VM speeds based on the "normal" and the "gentle" settings and pre-determined heat sealing time(s) based on the "dry" and "moist" food moisture content settings may be pre-programmed into the microprocessor M or be stored in look-up tables that are accessed by the microprocessor M.

After the appropriate pre-determined heat sealing time has elapsed, the microprocessor M signals the clamping motor CM to rotate in a reverse direction causing the cams C1, C2 to rotate in an opposite direction releasing the latches 154, 154. The clamping motor CM is energized until the latches 154, 154 are released and the linkage L1 contacts the switch S1 which signals the microprocessor M to de-energize the electronic controls 126, 128, 132, 134 and 136. At the same time, the left cam C2 urges against a pressure relief valve V (FIG. 7) to vent the lower pressure in the lower vacuum trough 180 to ambient to facilitate removal of the free end 61 of the container 60. The handle 160 may now be moved to the open configuration causing the front access door 150 to open and the free end 62 of the partially formed container 60 may be removed from the vacuum sealing compartment 140.

In an embodiment, the vacuum trough 180 may include the removable drip tray 184 for collecting excess liquids evacuated from the container 60. The drip tray 184 containing excess liquid evacuated from the container 60 may be removed and the excess liquid discarded. A similar drip tray is described and claimed in U.S. Pat. Nos. 7,003,928 and 7,076,929, both of which are owned by Jarden Consumer Solutions of Boca Raton, Fla., and are incorporated by reference as if fully rewritten herein. This completes the vacuum and sealing operational cycle of the food preservation container 60.

Figure 11:
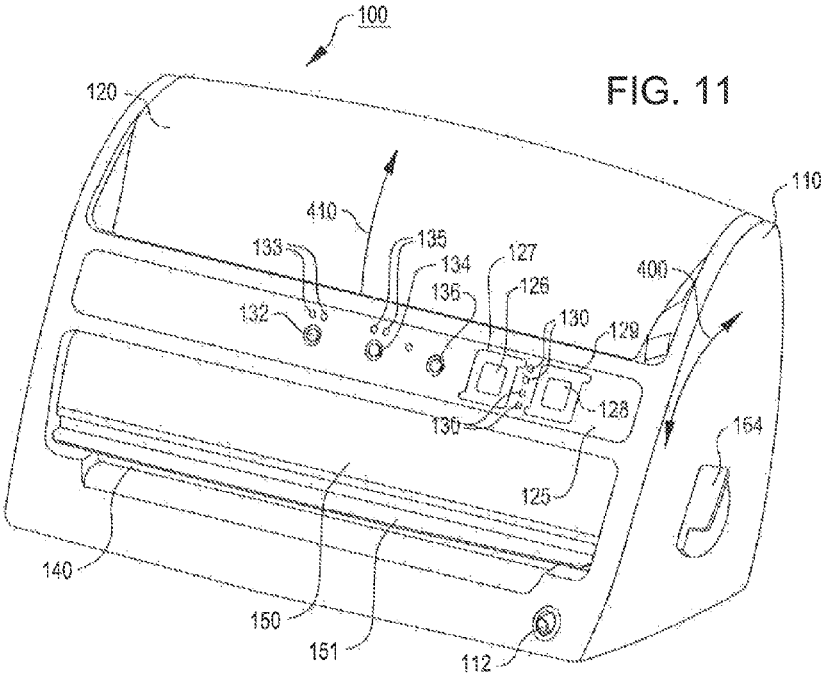
FIG. 11 shows a front perspective view of another embodiment of a vacuum packaging appliance with a roll storage compartment vertically disposed above a vacuum sealing chamber.

In an embodiment, the front access door 150 is moved between the open and closed configurations manually by the user grasping a lip 151 (FIG. 11) on the bottom of the front access door 150. A section of cut container material 60 may be inserted into the vacuum sealing compartment 140 as discussed above with the exception that the handle 160 is eliminated. The manual movement of the front access door 150 between the open and closed configurations also causes the upper vacuum chamber 185 to correspondingly move between the upper and lower positions. When the front access door 150 is moved to the closed position, a lever 164 (FIG. 11) on the side of the housing 110 may be pivoted to a first or downward position causing the linkage L1 to engage the switch S1. As previously discussed, the switch SW1 sends a signal to the microprocessor M to energize the clamping motor CM. The clamping motor CM through the plurality of gears G1, G2 through linkage L3 rotates the pair of cams C1, C2 on either side of the housing 110 in the first direction to engage the latches 154, 154 on the bottom of the front access door 150.

Once the front access door 150 is pulled tight into the locked position, the cam C1 on the right side of the housing 110 engages another switch S2 which turns off the clamping motor CM rotating the cams C1, C2. The engagement of the switch S2 also energizes the control panel 125 so that the electronic controls 126, 128, 132, 134 and 136 are operable. After performing vacuuming and/or sealing operations on the partially formed container 60, the lever (not shown) is pivoted in the opposite direction to a second or upward position which causes the linkage L1 to disengage the switch S1 to signal the microprocessor M to rotate the clamping motor CM in the opposite direction. The opposite rotation of clamping motor CM causes the cams C1, C2 to rotate in the second opposite direction to release the latches 154, 154 locking the front access door 150 and once released, the electronic controls 126, 128, 132, 134 and 136 are inoperable. The front access door 150 may now be moved to the open configuration manually and the container 60 may be removed from the vacuum sealing compartment 140.

Referring again particularly to FIG. 1, in an embodiment an accessory port 112 is disposed beneath the vacuum sealing compartment 140 and is provided for connecting an accessory hose 116 for evacuating a separate non-flexible container (not shown) such as a polypropylene or other canister containing a food item to be preserved. A connector 117 on one end of the accessory hose 116 connects to the accessory port 112. Another connector 117 on the opposite end of the accessory hose 116 connects to an adapter 119 that is fitted to an inlet on the container (not shown). The accessory hose 116 and connectors 117, 118 fluidly connect the non-flexible container (not shown) to a vacuum pump VM (FIG. 6) disposed in the base 110 which provides the necessary suction to evacuate the non-flexible container (not shown). The accessory port 112 may include a ball-valve that closes when the connector 117 is not connected to prevent loss of suction.

The vacuum pump VM (FIG. 6) is energized for providing the necessary suction to evacuate the canister (not shown) via the electronic controls 128, 132 and 136 controlled by the electronic control panel 125. The accessory hose 116, connectors 117, 118 and adapter 119 may be stored in a designated portion of the roll storage compartment 115 when not in use and may be accessed when the lid 120 is in the open position shown in FIG. 2. A pair of clips 121, 121 (FIG. 2) may be provided on the underside of lid 120 for securably storing the accessory hose 116 and connectors 117, 118 thereto.

With the handle 160 in the closed position, the electronic control 128 may be depressed to activate the vacuum motor VM which provides suction to the accessory port 112 which is applied to the container (not shown) through the accessory hose 116. After a pre-determined pressure is achieved in the vacuum tubing connecting the accessory port 112 to the vacuum motor VM, the pressure transducer P signals the microprocessor M to de-energize the vacuum motor VM so that the container (not shown) may be disconnected from the accessory hose 116 and sealed.

Referring now particularly to FIG. 6, a partially cutaway view of the interior of the housing 110 of the vacuum sealing appliance 100 is provided illustrating the vacuum motor VM, circuit board CB with microprocessor M and pressure transducer P, and the clamping motor CM. The exact arrangement of the vacuum motor VM, circuit board CB, pressure transducer P, and the clamping motor CM inside the housing 110 is exemplary and is not meant to be limiting in any sense.

In the exemplary embodiment illustrated, the vacuum motor VM is positioned in the left side of the housing 110 above and behind the upper vacuum chamber 185. In an embodiment, the vacuum motor VM is fluidly connected to the upper vacuum chamber 185 via tubing (not shown) for providing evacuating suction. In another embodiment, the vacuum motor VM is fluidly connected to the lower vacuum trough 180 via tubing (not shown) for providing evacuating suction.

The circuit board CB is disposed in the housing 110 adjacent to the vacuum motor VM. The pressure transducer P and microprocessor M are positioned on the circuit board CB. The pressure transducer P is fluidly connected to the vacuum motor VM via tubing (not shown). The valve V is also connected to the tubing (not shown) interconnecting the vacuum motor VM and the pressure transducer P. The clamping CM is disposed in the lower right front of the housing 110. The clamping motor CM is electrically and mechanically linked to the handle 160 via switches S1, S2 and linkages L1. The accessory port 112 is connected to the vacuum motor VM and the pressure transducer P via tubing (not shown).

Figure 10:
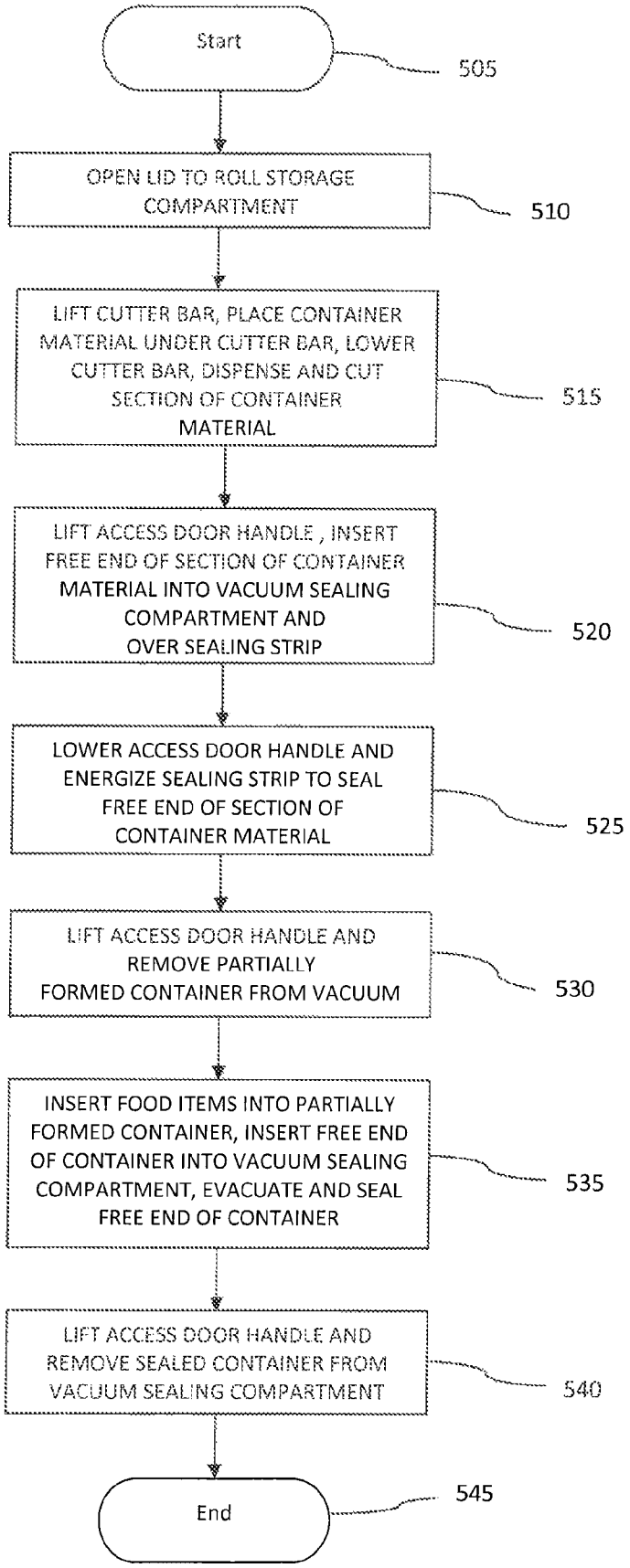
FIG. 10 shows a flowchart of a method of dispensing and vacuum sealing a container using the vacuum packaging appliance of FIG. 1.

The operation of the vacuum packaging appliance 100 of FIGS. 1-9 utilizing a method 500 for making a container 60 from a roll of container material and vacuum sealing the container 60 is illustrated in the flowchart in FIG. 10. The method begins in step 505. The method continues in step 510 comprising opening the lid 120 of the roll storage compartment 115 vertically disposed above the vacuum sealing compartment 140.

In step 515, the method 500 continues with the steps of lifting the cutter bar 170, placing one end of the container material under the cutter bar 170, lowering the cutter bar 170 and dispensing and cutting a section of the container material from the roll 50 of container material.

In step 520, the method 500 continues with the steps of lifting the access door handle 160 controlling movement of an access door 150 to the vacuum sealing compartment 140, and inserting a free end 62 of the section of container material into the vacuum sealing compartment 140 and over the heat sealing strip 190.

In step 525, the method 500 continues with the steps of lowering the access door handle 160 and energizing the heat sealing strip 190 to seal the free end 62 of the section of container material.

In step 530, the method 500 continues with the steps of lifting the access door handle 160 to open the access door 150 and removing the partially formed container 60 from the vacuum sealing compartment 140.

In step 535, the method 500 continues with the steps of inserting food items into the partially formed container 60, inserting the other free end 61 into the vacuum sealing compartment 140, and evacuating and sealing the other free end 61 of the container.

In step 540, the method 500 continues with the steps of lifting the access door handle 160 to open the access door 150 and removing the sealed container 60 from the vacuum sealing compartment 140.

In step 545, the method 500 ends.

All references cited herein are expressly incorporated by reference in their entirety.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. An appliance for vacuum packaging a container, comprising:

a base;

a vacuum motor disposed in the base;

a vacuum sealing compartment formed in the base including a vacuum trough fluidly connected to the vacuum motor;

a four-sided opening in a front panel of the base that opens into the vacuum sealing compartment;

a sealing element disposed in the vacuum sealing compartment adjacent the vacuum trough; and a storage compartment formed in the base vertically disposed above the vacuum sealing compartment and configured to store a roll of flexible container material;

a lid hingedly connected to an upper portion of the base pivotally movable between an open position allowing access to the storage compartment and a closed position enclosing the storage compartment;

wherein at least one section of the container material is dispensed from the storage compartment and cut from the roll of container material, sealed on a first free end with the sealing element to form an unsealed container, evacuated by the vacuum motor through a second free end inserted into the vacuum trough, and then sealed on the second free end with the sealing element to form a hermetically sealed container; and an access door covering the opening slidable between open and closed positions, said access door configured to allow the first and second free ends of the container to be inserted into the vacuum trough in the vacuum sealing compartment through the opening when in the open position and to seal the opening when in the closed position.

2. The appliance for vacuum packaging a container of claim 1, wherein food items are placed in the container prior to the second free end being placed into the vacuum trough.

3. The vacuum sealing appliance of claim 1, further comprising:

a handle pivotally connected to the base controlling the movement of the access door, the handle being movable between a first position corresponding to the access door being in the closed position and a second position corresponding to the access door being in the open position.

4. The vacuum sealing appliance of claim 3, further comprising:

an upper vacuum chamber movable between an upper position and a lower position and controlled by movement of the handle, wherein the upper vacuum chamber seals the vacuum trough when in the lower position and the vacuum trough is unsealed when the upper vacuum chamber is in the upper position;

wherein movement of the handle to the first position corresponds to the upper vacuum chamber being moved to the lower position and movement of the handle to the second position corresponds to the upper vacuum chamber being moved to the upper position.

5. The vacuum sealing appliance of claim 3, further comprising:

a clamping motor mechanically linked to the handle and a pair of cams that when rotated engage a pair of complementary latches on the access door;

wherein the clamping motor is energized to rotate the pair of cams only when the handle is in the first position and energized when a sealing or evacuation operation on the container is commenced, said cams being rotated in a first direction to engage the latches to lock the access door closed during the sealing or evacuation operation, and oppositely, said clamping motor is energized to rotate the pair of cams in a second opposite direction to release the latches to unlock the access door when the handle is moved to the second position after the evacuating or sealing operation on the container has been completed.

6. The vacuum sealing appliance of claim 3, further comprising:

an electronic control panel with electronic controls configured to control the vacuum motor and the sealing element, said electronic control panel being operative only when the handle is in the first position and inoperative when the handle is in the second position.

7. The vacuum sealing appliance of claim 1, further comprising:

a lever pivotally connected to one side of the housing movable between a first position and a second position; and a clamping motor mechanically linked to the lever and a pair of cams that when rotated by the clamping motor engage a pair of complementary latches on the access door;

wherein the access door is opened and closed manually by a user, and the clamping motor is energized to rotate the pair of cams only when the lever is in the first position and is energized when a sealing or evacuation operation on the container is commenced, said pair of cams being rotated in a first direction to engage the respective latch of the pair of latches to lock the access door closed during the sealing or evacuation operation, and oppositely, said clamping motor is energized to rotate the pair of cams in a second opposite direction to release the respective latch of the pair of latches to unlock the access door when the lever is moved to the second position after the evacuating or sealing operation on the container has been completed.

8. The vacuum sealing appliance of claim 7, further comprising:

an electronic control panel with electronic controls configured to control the vacuum motor and the sealing element, said electronic control panel being operative only when the lever is in the first position and inoperative when the lever is in the second position.

9. The vacuum sealing appliance of claim 1, further comprising:

an elongated cutting mechanism disposed inside of and pivotally attached to the storage compartment, said cutting mechanism extending longitudinally from one side of the storage compartment to an opposite side and having a cutting blade slidingly movable within a track back and forth between opposing sides of the cutting mechanism;

wherein the cutting mechanism is pivoted to allow a free end of the container material to be inserted underneath the cutting mechanism for further dispensing the section of the container material from within the storage compartment and cutting from the roll of container material by a user moving the cutting blade within the track back and forth between opposing sides of the cutting mechanism.

10. The vacuum sealing appliance of claim 1, wherein the sealing element is a heat sealing strip.

11. An appliance for dispensing, forming and evacuating a food storage bag, comprising:

a base;

a first compartment formed in a lower portion of the base;

a four-sided opening in a front panel of the base that opens into the first compartment;

a second compartment formed in the base vertically disposed above the first compartment configured to store a roll of food storage bag material;

a vacuum trough disposed in the first compartment;

a sealer disposed in the first compartment adjacent the vacuum trough; and a vacuum source fluidly connected to the vacuum trough;

wherein at least one section of the bag material is dispensed from the second compartment and cut from the roll of bag material, sealed on one free end with the sealer to form a partially formed container sealed on three sides, evacuated by the vacuum source through another free end opposite the one free end and inserted into the vacuum trough, and then sealed on the opposite free end with the sealer to form a hermetically sealed bag; and an access panel covering the opening slidable between open and closed positions, said access panel configured to allow the free ends of the bag to be inserted into the first compartment and the vacuum trough through the opening when in the open position and to cover the opening when in the closed position.

12. The appliance of claim 11, further comprising:

a handle pivotally connected to the base controlling the movement of the access panel, the handle being movable between a first position corresponding to the access panel being in the closed position and a second position corresponding to the access panel being in the open position.

13. The appliance of claim 12, further comprising:

an electronic control panel with electronic controls configured to control the vacuum source and the sealer, said electronic control panel being operative only when the handle is in the first position and inoperative when the handle is in the second position.

14. The appliance of claim 11, further comprising:

an elongated cutter bar pivotally connected to the second compartment, said cutter bar configured to cut a section of dispensed bag material from the roll of bag material disposed within the second compartment.

15. The appliance of claim 11, further comprising:

a lid pivotally attached to the base movable between a closed position for covering the second compartment and an open position wherein the roll of bag material is accessed.

16. An appliance for vacuum packaging a container, comprising:

a base;

a vacuum motor disposed in the base;

a vacuum sealing compartment formed in the base including a vacuum trough fluidly connected to the vacuum motor;

a sealing element disposed in the vacuum sealing compartment adjacent the vacuum trough;

a storage compartment formed in the base vertically disposed above the vacuum sealing compartment and configured to store a roll of flexible container material;

wherein at least one section of the container material is dispensed from the storage compartment and cut from the roll of container material, sealed on a first free end with the sealing element to form an unsealed container, evacuated by the vacuum motor through a second free end inserted into the vacuum trough, and then sealed on the second free end with the sealing element to form a hermetically sealed container;

an opening in the base that opens into the vacuum sealing compartment;

an access door covering the opening movable between open and closed positions, said access door configured to allow the first and second free ends of the container to be inserted into the vacuum trough in the vacuum sealing compartment when in the open position and to seal the opening when in the closed position;

a lever pivotally connected to one side of the housing movable between a first position and a second position; and a clamping motor mechanically linked to the lever and a pair of cams that when rotated by the clamping motor engage a pair of complementary latches on the access door;

wherein the access door is opened and closed manually by a user, and the clamping motor is energized to rotate the pair of cams only when the lever is in the first position and is energized when a sealing or evacuation operation on the container is commenced, said pair of cams being rotated in a first direction to engage the respective latch of the pair of latches to lock the access door closed during the sealing or evacuation operation, and oppositely, said clamping motor is energized to rotate the pair of cams in a second opposite direction to release the respective latch of the pair of latches to unlock the access door when the lever is moved to the second position after the evacuating or sealing operation on the container has been completed.

17. The vacuum sealing appliance of claim 16, further comprising:

an elongated cutting mechanism disposed inside of and pivotally attached to the storage compartment, said cutting mechanism extending longitudinally from one side of the storage compartment to an opposite side and having a cutting blade slidingly movable within a track back and forth between opposing sides of the cutting mechanism;

wherein the cutting mechanism is pivoted to allow a free end of the container material to be inserted underneath the cutting mechanism for further dispensing the section of the container material from within the storage compartment and cutting from the roll of container material by a user moving the cutting blade within the track back and forth between opposing sides of the cutting mechanism.

18. The vacuum sealing appliance of claim 16, further comprising:

an electronic control panel with electronic controls configured to control the vacuum motor and the sealing element, said electronic control panel being operative only when the lever is in the first position and inoperative when the lever is in the second position.

* * * * *